US007448622B2

(12) United States Patent
Kim

(10) Patent No.: US 7,448,622 B2
(45) Date of Patent: Nov. 11, 2008

(54) PAPER FEEDING CONTROL METHOD FOR AUTOMATIC DOCUMENT FEEDER

(75) Inventor: Yun-su Kim, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 278 days.

(21) Appl. No.: 11/221,708

(22) Filed: Sep. 9, 2005

(65) Prior Publication Data

US 2006/0071415 A1 Apr. 6, 2006

(30) Foreign Application Priority Data

Sep. 11, 2004 (KR) ..... 10-2004-0072835

(51) Int. Cl.
*B65H 7/02* (2006.01)

(52) U.S. Cl. ..... 271/265.01; 271/270; 271/266; 271/228

(58) Field of Classification Search ..... 271/265.01, 271/265.02, 270, 266, 264, 227, 228
See application file for complete search history.

(56) References Cited

U.S. PATENT DOCUMENTS 5,692,742 A * 12/1997 Tranquilla ..... 271/10.03
6,533,263 B2 * 3/2003 Tamura ..... 271/10.01
6,685,184 B2 * 2/2004 Tufekci et al. ..... 271/270

FOREIGN PATENT DOCUMENTS

| | | |
|---|---|---|
| JP | 58-104856 | 6/1983 |
| JP | 60-023238 | 2/1985 |
| JP | 02-233437 | 9/1990 |
| JP | 06-247591 | 9/1994 |
| JP | 2001-080789 | 3/2001 |
| KR | 10-2000-0056713 A | 9/2000 |
| KR | 10-2001-0047490 A | 6/2001 |

* cited by examiner

*Primary Examiner*—Kaitlin S Joerger
(74) *Attorney, Agent, or Firm*—Roylance, Abrams, Berdo & Goodman, LLP

(57) ABSTRACT

A method for an automatic document feeder which can control the feeding of a following sheet such that the following sheet can be delayed for a predetermined time when the interval between sheets is shortened, thereby maintaining a constant interval between the sheets. The method and apparatus comprises a paper feeding roller, an arranging roller for arranging a front end of a document being fed by the paper feeding roller and for transferring the document, and an arranging sensor disposed at a front portion of the arranging roller to detect whether the document is being transferred. The arranging sensor detects a rear end of a previous sheet and a front end of a next sheet, and an operation of the arranging roller is controlled using a time interval between the previous sheet and the next sheet.

11 Claims, 3 Drawing Sheets

PAPER FEEDING CONTROL METHOD FOR AUTOMATIC DOCUMENT FEEDER

CROSS-REFERENCE TO RELATED APPLICATIONS

This application claims the benefit under 35 U.S.C. §119 (a) of Korean Patent Application No. 10-2004-0072835 filed in the Korean Intellectual Property Office on Sep. 11, 2004, the entire disclosure of which is hereby incorporated by reference.

BACKGROUND OF THE INVENTION

1. Field of the Invention

The present invention relates to an automatic document feeder employed in office appliances such as a photocopy machine, scanner, facsimile and multi-function office machine. More particularly, the present invention relates to a method for creating uniform intervals between document sheets being fed.

2. Description of the Related Art

Automatic document feeders used with multi-function office machines typically comprise a paper feeding tray where a document, often having a plurality of paper sheets, is set, a paper feeding roller for separately transferring the document on the paper feeding tray sheet by sheet, an arranging roller for arranging a front end of the document being transferred by the paper feeding roller, a scanning roller for taking the document being transferred by the arranging roller to an image reading sensor, a gate roller for transferring the read document toward a paper discharging part, and a paper discharging roller.

The paper feeding tray has a document sensor for detecting whether the document is set thereon, and the arranging roller has an arranging sensor for detecting the transfer of the document at a front portion thereof. Also, the scanning roller has a scanning sensor at a rear portion thereof for detecting an entering point of the document toward the image reading sensor, and the gate roller has a gate sensor at a rear portion thereof for detecting the transfer of the document.

In the example wherein a duplex scanning mode is provided, the automatic document feeder further comprises a duplex document path, a duplex gate for guiding the document to the duplex document path, a document entering sensor for detecting the document entering the duplex document path, and a duplex document transfer roller.

In the general automatic document feeder as described above, as a paper feeding clutch is turned on, the paper feeding roller is rotated, thereby feeding the plurality of paper sheets of a document set on the paper feeding tray one by one. The front end of the document transferred by the paper feeding roller is arranged by the arranging roller. As an arranging clutch is turned on, the arranging roller is rotated and therefore, the document is continuously transferred. At this time, the arranging sensor is in an on state, while the paper feeding clutch is in an off state. When the arranging sensor is turned off as the document passes therethrough, the paper feeding clutch is turned on again, thereby rotating the paper feeding roller to feed the next sheet of the document.

To summarize, in the conventional automatic document feeder, a next sheet is fed after a previous sheet is completely passed through the arranging sensor, such that an interval between the sheets is constantly maintained.

However, according to such conventional paper feeding methods, even when a sheet is fed together with a previous sheet by error, the following sheet is continuously fed because the arranging sensor is turned off. Therefore, the intervals between sheets may be shortened and this may cause malfunctions of the sensors or paper jams.

In addition, such variation of the intervals between the sheets deteriorates the reliability of the production of machines, such as the photocopy machine or the multi-function office machine. For example, the number of scanned sheets per minute may differ from a preset value.

Accordingly, a need exists for a system and method for controlling the intervals between sheets such that malfunctions of the sensors and paper jams can be minimized.

SUMMARY OF THE INVENTION

An aspect of the present invention is to solve at least the above and other problems and disadvantages, and to provide at least the advantages described below. Accordingly, an aspect of the present invention is to provide a method for an automatic document feeder that is capable of controlling intervals between sheets such that the intervals are substantially constant during document feeding.

In order to achieve the above-described aspects of the present invention, a method is provided for an automatic document feeder that comprises a paper feeding roller, an arranging roller for arranging a front end of a document being fed by the paper feeding roller and for transferring the document, and an arranging sensor disposed at a front portion of the arranging roller to detect whether the document is being transferred. The arranging sensor detects a rear end of a previous sheet and a front end of a next sheet, and an operation of the arranging roller is controlled using a time interval between the previous sheet and the next sheet.

According to an embodiment of the present invention, time is measured from a time point where the arranging sensor is turned off by the rear end of the previous sheet passed through the arranging sensor, to a time point where the arranging sensor is turned on by the front end of the next sheet touching the arranging sensor. The measured time is compared with a reference time, and if the measured time is shorter than the reference time, the transfer of the next sheet is delayed by pausing the arranging roller for a predetermined time.

The predetermined time for pausing the arranging roller corresponds to a difference between the measured time and the reference time.

If the arranging sensor is not turned off or on, even after the predetermined time, it is determined that a paper jam has occurred.

According to another embodiment of the present invention, a method is provided for an automatic document feeder that comprises a paper feeding roller for feeding paper sheets, an arranging roller for arranging a front end of a document being fed by the paper feeding roller and for transferring the document, and an arranging sensor disposed at a front portion of the arranging roller to detect whether the document is being transferred. The method comprises the steps of detecting whether the document is set on a paper feeding tray, driving the paper feeding roller until the arranging sensor is turned on, thereby feeding one sheet of the document, driving the arranging roller to maintain the transfer of the document and for pausing the paper feeding roller, re-driving the paper feeding roller when the arranging sensor is turned off, thereby feeding a next sheet of the document, detecting a rear end of a previous sheet progressing to the arranging sensor and a front end of a next sheet following the previous sheet, and controlling the operation of the arranging roller using a time interval between the previous sheet and the next sheet.

According to the above exemplary embodiments of the present invention, when the interval between the sheets is shortened, the feeding of the next sheet can be delayed, thereby maintaining a constant interval. Accordingly, problems occurring in the prior art due to the shortened interval can be solved.

BRIEF DESCRIPTION OF THE DRAWING FIGURES

The above aspects and other features of the present invention will become more apparent by describing in detail exemplary embodiments thereof with reference to the attached drawing figures, wherein.

Throughout the drawings, like reference numerals will be understood to refer to like parts, components and structures.

DETAILED DESCRIPTION OF EXEMPLARY EMBODIMENTS

Figure 1:
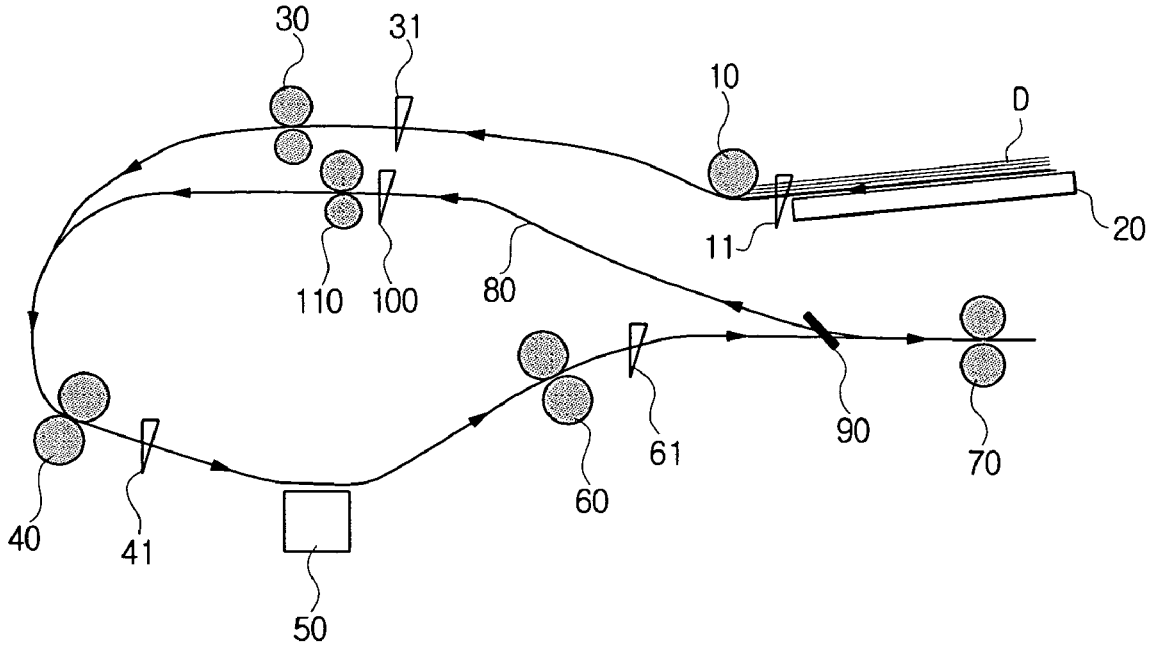
FIG. 1 is a model diagram illustrating an exemplary automatic document feeder having a duplex scanning mode according to an embodiment of the present invention.

Hereinafter, exemplary embodiments of the present invention will be described in detail with reference to the accompanying drawing figures.

In the following description, same drawing reference numerals are used for the same elements even in different drawings. The matters defined in the description, such as detailed construction and element descriptions, are provided to assist in a comprehensive understanding of the invention. Also, functions or constructions well known to those skilled in the art are omitted for clarity and conciseness.

FIG. 1 is a model diagram schematically showing an automatic document feeder according to an embodiment of the present invention. A paper feeding roller 10 is connected to a driving source (not shown) by a paper feeding clutch and is selectively rotated to separate and transfer a top sheet from among a plurality of sheets of a document D set on a paper feeding tray 20. A document sensor 11 detects whether the document D is set on the paper feeding tray 20.

An arranging roller 30 arranges a front end of the document D being transferred by the paper feeding roller 10 and keeps transferring the document D. An arranging sensor 31 detects whether the document D is being transferred. The arranging roller 30 is connected to a driving source (not shown) by an arranging clutch to be selectively rotated.

A scanning roller 40 takes the document D being transferred by the arranging roller 30 to an image reading sensor 50, and a scanning sensor 41 detects an entering point of the document D toward the image reading sensor 50.

A gate roller 60 transfers the read document D toward a paper discharging part, and a gate sensor 61 detects the transfer of the document D. A paper discharging roller 70 then discharges the document to the outside.

A duplex unit reverses and transfers the document D for a duplex scanning mode. The duplex unit comprises a duplex document path 80 having a duplex gate 90 at an entering point for the document D. The duplex gate 90 directs the document D, of which one side is scanned, toward the duplex document path 80. The duplex document path 80 has a document entering sensor 100 for detecting the document D entering thereto and a duplex document transferring roller 110.

Figure 2:
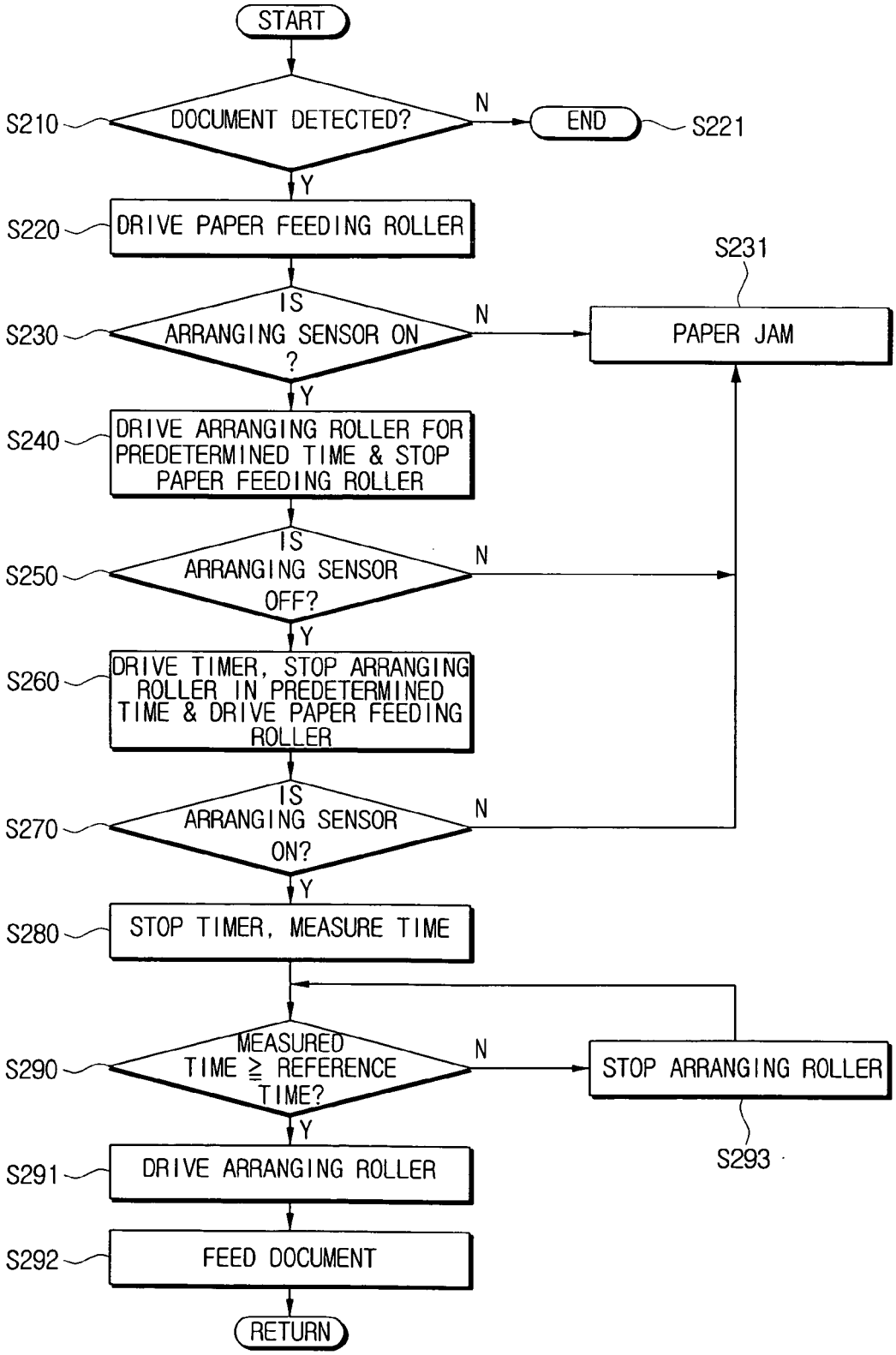
FIG. 2 is a flowchart for explaining an exemplary method for an automatic document feeder according to an embodiment of the present invention.

FIG. 2 is a flowchart for explaining a method for an automatic document feeder according to an embodiment of the present invention.

As shown in FIGS. 1 and 2, a first step detects whether the document D is set on the paper feeding tray 20 at step (S210). When the document senor 11 that is disposed at the paper feeding tray 20 is turned on from an off state, the document D is determined to be set on the paper feeding tray 20. If the document sensor 11 is maintained in the off state, the document D is determined to be unset, or missing from the paper feeding tray 20.

When setting of the document D is detected in step (S210), the paper feeding clutch is turned on to rotate the paper feeding roller 10 at step (S220). However, when it is determined that the document D is unset, the automatic document feeder finishes the operation at step (S221). By the operation of step (S220), a sheet of the document D set on the paper feeding tray 20 is transferred.

As the front end of the transferred document D contacts the arranging sensor 31, an 'on' signal is input at step (S230). Therefore, a controller (not shown) drives the arranging roller 30 for a predetermined time to continue the transfer of the document D, and also terminates the driving of the paper feeding roller 10 at step (S240). However, if the arranging sensor is not turned on even after a predetermined time, it is determined that a paper jam has occurred at step (S231).

The controller determines whether the arranging sensor 31 is turned off at step (S250). If the arranging sensor is turned off, a section corresponding to a document D1 (as shown and described in greater detail below with reference to FIG. 3), which is a previous sheet, is determined to be successfully transferred. Accordingly, after the predetermined time, the arranging roller 30 is paused while the paper feeding roller 10 is driven, such that a document D2 (as shown and described in greater detail below with reference to FIG. 3), which is a next sheet, is fed. In step (S260), the controller therefore operates a timer for the above operations.

When the arranging sensor 31 is turned on as the document D2, fed by the paper feeding roller 10, progresses so that the front end thereof comes into contact with the arranging sensor 31 at step (S270), the controller stops the timer and measures the time between a time point where the arranging sensor 31 is turned off and a time point where the arranging sensor 31 is turned on at step (S280).

Next, the controller compares the measured time with a preset reference time at step (S290). If the measured time is equal to or greater than the reference time, the controller drives the arranging roller 30 at step (S291) to normally transfer the document D2 at step (S292). If the measured time is less than the reference time, the controller pauses the arranging roller 30 for a predetermined time, thereby delaying the transfer of the document D2 at step (S293).

The predetermined time for pausing the arranging roller 30 corresponds to a difference between the measured time and the reference time. When the measured time and the reference time are the same, steps (S291) and (S292) are performed.

Hereinbelow, the time being measured to obtain a distance between the document D1 and document D2 will be described in greater detail with reference to FIG. 3.

Figure 3:
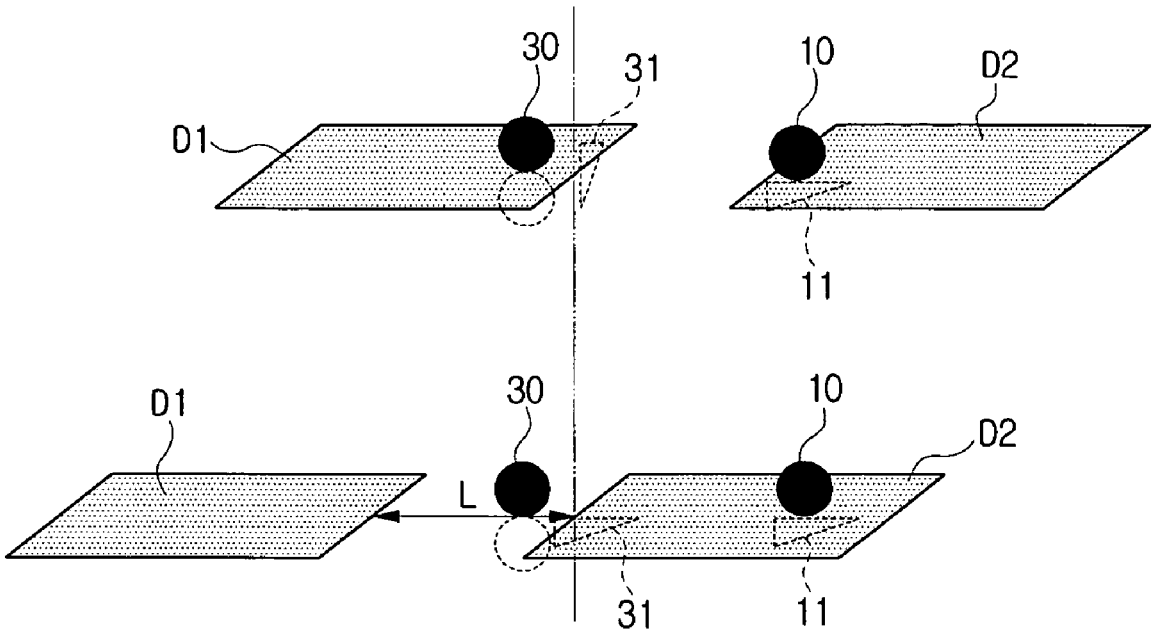
FIG. 3 is a model diagram for explaining a principle of an exemplary method for an automatic document feeder according to an embodiment of the present invention.

In FIG. 3, a first perspective view of documents D1 and D2 at a first position are shown aligned above a second perspective view of documents D1 and D2 at a second position. The first perspective view of FIG. 3 shows that a rear end of the document D1 has just passed through the arranging sensor 31, such that the arranging sensor 31 is turned off, and therefore the document D2 is fed. The second perspective view of documents D1 and D2 of FIG. 3 shows that the document D1 progresses after passing through the arranging sensor 31, and that the document D2 is transferred so that a front end thereof touches the arranging sensor 31, thereby turning on the arranging sensor 31.

The controller measures the time from a time point where the arranging sensor 31 is turned off by the document D1 to a time point where the arranging sensor 31 is turned on by the document D2. Using the measured time, the distance L from the rear end of the document D1 to the front end of the document D2 can be calculated.

When the calculated distance L is less than a preset reference distance, the transfer of the document D2 is delayed such that the calculated distance L is equal to the reference distance. As a result, the intervals between the sheets can be uniform.

As can be appreciated from the above description of the automatic document feeder, although the interval between a previous sheet and a next sheet becomes short, the intervals between the sheets can be constantly maintained by delaying the transfer of the next document for a predetermined time. Accordingly, malfunctions of the sensors and paper jams, caused due to the shortened document interval, can be minimized.

Also, the constant intervals between the sheets may increase reliability of the apparatus because the number of scanned sheets per minute can be uniform for example.

While the invention has been shown and described with reference to certain embodiments thereof, it will be understood by those skilled in the art that various changes in form and details may be made therein without departing from the spirit and scope of the invention as defined by the appended claims.

What is claimed is:

1. A method for controlling an automatic document feeder that comprises a paper feeding roller, an arranging roller for aligning a front end of a sheet being fed by the paper feeding roller and for transferring the sheet, and an arranging sensor disposed at a transfer path point after the paper feeding roller and before a front portion of the arranging roller, comprising the steps of:

detecting at the transfer path point after the paper feeding roller and before the arranging roller, whether the sheet is being transferred;

detecting at the transfer path point after the paper feeding roller and before the arranging roller, a rear end of a previous sheet and a front end of a next sheet; and selectively controlling a start and pause operation of both the arranging roller and the paper feeding roller using the arranging sensor output and a time interval between the previous sheet and the next sheet to control an interval between sheets.

2. The method of claim 1, wherein the controlling step comprises the steps of:

measuring the time interval from a time point where the arranging sensor is turned off by the rear end of the previous sheet passing though the arranging sensor, to a time point where the arranging sensor is turned on by the front end of the next sheet touching the arranging sensor; and comparing the measured time with a reference time, and if the measured time is shorter than the reference time, delaying the transfer of the next sheet by pausing the arranging roller for a predetermined time.

3. The method of claim 2, wherein the predetermined time for pausing the arranging roller corresponds to a difference between the measured time and the reference time.

4. The method of claim 2, further comprising the step of:

determining that a paper jam has occurred if the arranging sensor is not turned off or on after the predetermined time.

5. A method for controlling an automatic document feeder that comprises a paper feeding roller for feeding paper sheets, an arranging roller for aligning a front end of a sheet being fed by the paper feeding roller and for transferring the sheet, and an arranging sensor disposed at a transfer path point after the paper feeding roller and before a front portion of the arranging roller to detect whether the sheet is being transferred, the method comprising the steps of:

detecting one or more sheets of the document;

driving the paper feeding roller until the arranging sensor is turned on by sensing a sheet at the transfer path point after the paper feeding roller and before the arranging roller, thereby feeding one sheet of the document;

driving the arranging roller to transfer the sheet and pausing the paper feeding roller;

re-driving the paper feeding roller when the arranging sensor is turned off, thereby feeding a next sheet of the document;

detecting at the transfer path point after the paper feeding roller and before the arranging roller, a rear end of a previous sheet passing the arranging sensor and a front end of a next sheet following the previous sheet; and selectively controlling a start and pause operation of both the arranging roller and the paper feeding roller using the arranging sensor output and a time interval between the previous sheet and the next sheet to control an interval between sheets.

6. The method of claim 5, wherein the controlling step comprises the steps of:

measuring the time interval from a time point where the arranging sensor is turned off by the rear end of the previous sheet passing through the arranging sensor, to a time point where the arranging sensor is turned on by the front end of the next sheet touching the arranging sensor; and comparing the measured time with a reference time, and if the measured time is shorter than the reference time, delaying the transfer of the next sheet by pausing the arranging roller for a predetermined time.

7. The method of claim 6, wherein the predetermined time for pausing the arranging roller corresponds to a difference between the measured time and the reference time.

8. The method of claim 6, further comprising the step of:

determining that a paper jam has occurred if the arranging sensor is not turned off or on after the predetermined time.

9. An automatic document feeder comprising:

a paper feeding roller;

an arranging roller for arranging a front end of a sheet being fed by the paper feeding roller and for transferring the sheet;

an arranging sensor disposed at a transfer path point after the paper feeding roller and before a front portion of the arranging roller to detect whether the sheet is being transferred, wherein the arranging sensor detects a rear end of a previous sheet and a front end of a next sheet; and a controller for selectively controlling a start and pause operation of both the arranging roller and the paper feeding roller using the arranging sensor output and a time interval between the previous sheet and the next sheet.

10. The automatic document feeder of claim 9, further comprising:

a timer for measuring the interval between a time point where the arranging sensor is turned off by the rear end of the previous sheet passing through the arranging sensor, to a time point where the arranging sensor is turned on by the front end of the next sheet touching the arranging sensor; and wherein the controller is configured to compare the measured time with a reference time, and if the measured time is shorter than the reference time, delaying the transfer of the next sheet by pausing the arranging roller for a predetermined time.

11. The automatic document feeder of claim 10, wherein the predetermined time for pausing the arranging roller corresponds to a difference between the measured time and the reference time.

* * * * *